US010448193B2

(12) United States Patent
Van Laack et al.

(10) Patent No.: US 10,448,193 B2
(45) Date of Patent: Oct. 15, 2019

(54) PROVIDING AN AUDIO ENVIRONMENT BASED ON A DETERMINED LOUDSPEAKER POSITION AND ORIENTATION

(71) Applicant: Visteon Global Technologies, Inc., Van Buren Township, MI (US)

(72) Inventors: Alexander Van Laack, Aachen (DE); Peter Wasserfuhr, Cologne (DE); Bertrand Stelandre, Thimister (BE)

(73) Assignee: Visteon Global Technologies, Inc., Van Buren Township, MI (US)

( * ) Notice: Subject to any disclaimer, the term of this patent is extended or adjusted under 35 U.S.C. 154(b) by 0 days.

(21) Appl. No.: 15/441,960

(22) Filed: Feb. 24, 2017

(65) Prior Publication Data

US 2017/0245091 A1 Aug. 24, 2017

(30) Foreign Application Priority Data

Feb. 24, 2016 (DE) ..... 10 2016 103 209

(51) Int. Cl.
*H04S 7/00* (2006.01)
*H04R 5/02* (2006.01)

(52) U.S. Cl.
CPC ..... *H04S 7/308* (2013.01); *H04R 5/02* (2013.01); *H04S 7/301* (2013.01); *H04R 2205/024* (2013.01); *H04R 2420/07* (2013.01); *H04S 2400/11* (2013.01)

(58) Field of Classification Search
None
See application file for complete search history.

(56) References Cited

U.S. PATENT DOCUMENTS

| | | | | |
|---|---|---|---|---|
| 5,386,478 | A | 1/1995 | Plunkett | |
| 8,260,009 | B2 | 9/2012 | Du et al. | |
| 8,494,189 | B2 | 7/2013 | Katayama | |
| 2004/0071294 | A1 | 4/2004 | Halgas, Jr. et al. | |
| 2005/0105744 | A1* | 5/2005 | Lee | H04S 7/302 381/86 |
| 2009/0192638 | A1 | 7/2009 | Van Leest et al. | |
| 2010/0260360 | A1 | 10/2010 | Strub | |
| 2012/0290254 | A1 | 11/2012 | Thrun et al. | |
| 2013/0022221 | A1 | 1/2013 | Kallai et al. | |
| 2013/0170655 | A1* | 7/2013 | Satoyoshi | G10K 11/175 381/56 |

(Continued)

FOREIGN PATENT DOCUMENTS

| | | | |
|---|---|---|---|
| DE | 10 2009 015 174 | A1 | 10/2010 |
| EP | 1 641 318 | A1 | 3/2006 |

(Continued)

OTHER PUBLICATIONS

Office Action, dated Jul. 26, 2018, issued in related German Application No. 10 2016 103 209.3, filed Feb. 24, 2016.

*Primary Examiner* — Curtis A Kuntz
*Assistant Examiner* — Kenny H Truong
(74) *Attorney, Agent, or Firm* — Dickinson Wright PLLC

(57) ABSTRACT

The aspects disclosed herein are related to providing a stereoscopic audio environment that is based on speaker position and/or orientation. Once the speaker (or groups of speakers) are identified by the above-described techniques, the audio signal uniquely delivered to each of the speakers may be customized to produce an optimal sound environment.

20 Claims, 2 Drawing Sheets

(56) References Cited

U.S. PATENT DOCUMENTS

| | | | | |
|---|---|---|---|---|
| 2014/0161265 | A1 | 6/2014 | Chaikin et al. | |
| 2014/0219456 | A1 | 8/2014 | Morrell et al. | |
| 2014/0219483 | A1* | 8/2014 | Hong | H04R 5/02 381/307 |
| 2015/0010169 | A1 | 1/2015 | Popova | |
| 2015/0016642 | A1* | 1/2015 | Walsh | H04S 7/301 381/307 |
| 2015/0382128 | A1 | 12/2015 | Ridihalgh et al. | |
| 2016/0007118 | A1* | 1/2016 | Lee | H04S 7/301 381/303 |

FOREIGN PATENT DOCUMENTS

| | | | |
|---|---|---|---|
| EP | 1 266 541 | B1 | 5/2006 |
| EP | 1 542 503 | B1 | 8/2011 |
| EP | 2 363 723 | A1 | 9/2011 |
| EP | 2 860 992 | A1 | 4/2015 |
| EP | 2 881 708 | A1 | 6/2015 |
| EP | 2 891 338 | | 7/2015 |
| WO | 2010/140088 | A1 | 12/2010 |
| WO | 2014/036121 | A1 | 3/2014 |
| WO | 2014/171420 | A1 | 10/2014 |
| WO | 2014/192744 | A1 | 12/2014 |
| WO | 2015/105809 | A1 | 7/2015 |
| WO | 2015/108824 | A1 | 7/2015 |
| WO | 2015/117616 | A1 | 8/2015 |

* cited by examiner

PROVIDING AN AUDIO ENVIRONMENT BASED ON A DETERMINED LOUDSPEAKER POSITION AND ORIENTATION

CROSS REFERENCE TO RELATED APPLICATION

This application claims priority to German Provisional Patent application no. 10 2016 103 209 3, filed Feb. 24, 2016, entitled "System and method for position detection of loudspeakers and for reproduction of audio signals as stereoscopic sound," now pending, the entire disclosure of the application being considered part of the disclosure of this application and hereby incorporated by reference.

BACKGROUND

In known audio systems of the prior art for the creation of a stereoscopic sound from several audio tracks, such as 5.1 or 7.1, that is, with the aid of five or seven loudspeakers and one bass loudspeaker each, the individual loudspeakers must be arranged and oriented each time very exactly by distance to the audience and among each other in order to provide the desired stereoscopic sound. Due to the local circumstances of the installation room, it is often very difficult if not impossible to arrange the loudspeakers to create a high-quality stereoscopic sound. If the local circumstances are inadequate for the arrangement of the loudspeakers within the installation room, only a poor sound quality and a very poor listening experience can be achieved.

If the local circumstances of the installation room allow a free arrangement of the loudspeakers, nevertheless the arrangements of the individual loudspeakers entail a high cost of measurement procedures in order to achieve a good listening experience. The positions of the loudspeakers need to be determined manually, which on the one hand is very time consuming and on the other hand very prone to mistakes.

Also with traditional object-based audio systems in which a sound is created through a corresponding wave field, coming very close to the tones of actual objects, the precise knowledge of the location and the orientation of each individual loudspeaker is required in order to create an optimal sound. Only with knowledge of the location and the orientation of each individual loudspeaker can the corresponding sound waves be created.

In U.S. Pat. No. 8,494,189 B2 a device is described for the automatic position detection of loudspeakers, which uses the positions of the loudspeakers in order to create a virtual sound around a listener, that is, a virtual sound room. Each time the distances between the positions of the individual loudspeakers and the listener are calculated.

In US 2014/0219456 A1 techniques are disclosed for systems with at least one signal processor for the determination of spherical function coefficients for the generating of one or more loudspeaker signals. The system is designed to identify a local loudspeaker arrangement and to ascertain, based on the local loudspeaker arrangement, which signal processor to activate. The signal processor is likewise configured to determine the distances to the loudspeakers.

From EP 2 363 723 A1 there is known a location system, a method and a device for localization inside an interior room.

In US 2004/0071294 A1 a method is disclosed for the automatic setup of a loudspeaker system. The method is based on a technology for transceiver systems for the automatic and non-contact identification and location of objects with radio waves, that is, the transmission of signals for identification with the help of electromagnetic waves, abbreviated as RFID (radio-frequency identification). A RFID system comprises a transponder, also known as a radio tag, on the object being located, with a characteristic code, as well as a reading device for reading the code. Each loudspeaker is outfitted with a transponder and a code. At the place in the room favored by the listener, a wireless communication element is arranged. With the help of the RFID system as well as the wireless communication element, the respective distance between the location favored by the listener in the room and a loudspeaker is determined and transmitted to a loudspeaker control unit.

Furthermore, traditional systems are known for position detection, such as that of mobile devices in an indoor room. The systems are designed either to compare a signal of an identifier against a list of corresponding identifiers in different regions of the room or the systems are designed to follow the movement of the mobile device in relation to an image of the room, in order to determine the position of the mobile device.

For example, from EP 2 881 708 A1 there is known a system and a method for locating of mobile electronic devices in an indoor room.

The systems and methods known from the prior art are very complex and require a large technical expense. Thus, for example, due to the local circumstances of the installation room, either the loudspeakers cannot be arranged so as to generate an optimal stereoscopic sound, or the arrangements of the individual loudspeakers are very time consuming and very prone to mistakes, as well as associated with a high technical expense for measurements in order to achieve a good listening experience. Each position of a loudspeaker needs to be determined individually. The individual loudspeakers of the loudspeaker system cannot be arranged arbitrarily in the room, but instead have to be assigned a particular setup location so that no flexible arrangement of the loudspeakers or the listener is possible.

SUMMARY

The disclosure concerns a system for the position detection of loudspeakers and for the reproduction of audio signals as stereoscopic sound. The system comprises a base unit with at least one signal processor as well as at least one loudspeaker for sending out audio signals. The loudspeaker is arranged at a distance from the base unit in an installation room.

The disclosure furthermore concerns a method for the position detection of loudspeakers and for the reproduction of audio signals as stereoscopic sound with the system according to the disclosure.

The problem which the disclosure proposes to solve is to provide a system and a method for the position detection of loudspeakers and for the reproduction of audio signals as stereoscopic sound, especially in a passenger space of a motor vehicle. It should be easy to operate the system and the local circumstances of the installation room should play only a subordinate or no role in the generating of an optimal stereoscopic sound. The system should be able to be produced with minimal expense, for example, in terms of time and measurement techniques, it should have a minimal number of components, and it should cause only minimal costs, as well as not be error-prone. It should be possible to arrange the loudspeakers at will and flexibly in the room, and also in relation to the listener.

The problem is solved by the objects with the features of the independent patent claims. Modifications are given in the dependent patent claims.

The problem is solved by a system according to the disclosure for the position detection of loudspeakers and for the reproduction of audio signals as stereoscopic sound. The system comprises a base unit with at least one signal processor as well as at least one loudspeaker for sending out audio signals. The loudspeaker is arranged at a distance from the base unit in an installation room.

According to the concept of the disclosure, the at least one loudspeaker is configured so as to send out audio signals as well as communicate with the signal processor of the base unit, in particular, to send data to the base unit and to receive data from the base unit. The signal processor according to the disclosure is configured so as to generate data for the sending of audio signals and to receive data for the determining of a position and orientation of the at least one loudspeaker. The position and the orientation of the at least one loudspeaker in the system is automatically detected and processed by the signal processor.

According to one preferred embodiment of the disclosure, the base unit with the at least one signal processor as well as the at least one loudspeaker are arranged within a system of coordinates with an origin of coordinates. The system detects the position and the orientation of the at least one loudspeaker by distances from the origin of coordinates.

The base unit with the at least one signal processor is advantageously arranged at the origin of coordinates of the system of coordinates as a reference point.

According to one modification of the disclosure, the signal processor and the at least one loudspeaker are connected to each other wirelessly for the transmitting of data.

According to one alternative embodiment of the disclosure, the components of the data transmission system are coupled together by wired connections.

According to one advantageous embodiment of the disclosure, a plurality of loudspeakers is configured. The system is configured so that the positions and the orientations of the loudspeakers as well as the relative associations of the loudspeakers with each other are detected automatically.

By a plurality of loudspeakers is meant at least two loudspeakers. The loudspeakers are advantageously arranged and oriented in a three-dimensional space with directions x, y and z or within the system of coordinates.

The signal processor is preferably configured so as to decompose the audio signals. In this, the position detection of each individual loudspeaker goes into the parameters of the decomposition of the audio signals and into a calculation of the audio signals to be sent out from each loudspeaker.

According to one alternative embodiment of the disclosure, each loudspeaker of the plurality of loudspeakers is associated with a signal processor. The signal processors are designed to be mutually controllable.

The problem is also solved by a method according to the disclosure for the position detection of loudspeakers and for the reproduction of audio signals as stereoscopic sound with the system according to the disclosure with a base unit with at least one signal processor as well as loudspeakers for sending out of audio signals. The method involves the following steps:

automatic detecting of absolute positions and orientations of the loudspeakers in an installation room as well as sending of data on the absolute positions and orientations to the at least one signal processor, automatic determination of relative positions of the loudspeakers to each other and distances of the loudspeakers from each other, receiving and decomposing of audio information of at least one audio source by the at least one signal processor, calculating of audio signals to be sent individually by each loudspeaker, taking into account the relative positions of the loudspeakers determined with the position detection of the loudspeakers by the at least one signal processor, sending of the audio signals to be sent individually by the at least one signal processor to the loudspeakers and reproduction of the audio signals by the loudspeakers, generating a virtual sound room in dependence on the positions and the orientation of the loudspeakers.

In the automatic determination of the relative positions of the loudspeakers to each other and the distances of the loudspeakers from each other it is to be assumed that all positions and distances will be processed by the signal processor, without each individual loudspeaker taking account of the positions of the other loudspeakers or the individual distances from the other loudspeakers or even the individual distances of the other loudspeakers from each other.

The properties of the audio signals are advantageously adapted automatically by the signal processor. This enables a flexible sound reproduction regardless of the positions, the arrangements and the orientations of the loudspeakers.

According to one alternative embodiment in which each loudspeaker is associated with a signal processor, an individual audio signal is calculated for each loudspeaker by the associated signal processor.

According to one modification of the disclosure, in which the base unit with the at least one signal processor as well as the loudspeakers are arranged within a system of coordinates with an origin of coordinates as a reference point, the positions and orientations of the loudspeakers are detected automatically by distances from the origin of coordinates.

A preferred embodiment of the disclosure consists in that the individual steps of the method are based on the use of a communication protocols.

By a communication protocol is meant an agreement whereby the data transmission occurs between two or more components. The protocol defines the set of rules, the syntax, semantics and synchronization of the data transmission as a communication.

The advantageous embodiment of the disclosure, especially in regard to the automatic detecting of the positions of the loudspeakers in the installation room, enables the use of the system or the method for the position detection of loudspeakers and for the reproduction of audio signals as stereoscopic sound and an object-based sound system in a passenger compartment of a motor vehicle.

The system according to the disclosure and the method according to the disclosure for the position detection of loudspeakers and for the reproduction of audio signals as stereoscopic sound have various advantages. In summary:

no individual determination of the positions of the loudspeakers is needed, users can arrange the individual loudspeakers of the loudspeaker system howsoever they desire in the installation room, since the position of each individual loudspeaker is detected by the system and appropriately further processed in the signal processor and each time corresponding audio signals for output by the loudspeakers are calculated, so that an optimal stereoscopic sound is always generated, the system enables a sound reproduction independent of loudspeaker, good flexibility in the arrangement of the loudspeakers simple operation with minimum error possibility for the system, minimum expense of time and measurement procedures for placement in operation, and very large optimal listening range.

BRIEF DESCRIPTION OF THE DRAWINGS

Further details, features and benefits of embodiments of the disclosure will appear from the following description of sample embodiments making reference to the accompanying figures, which show.

DETAILED DESCRIPTION

Figure 1:
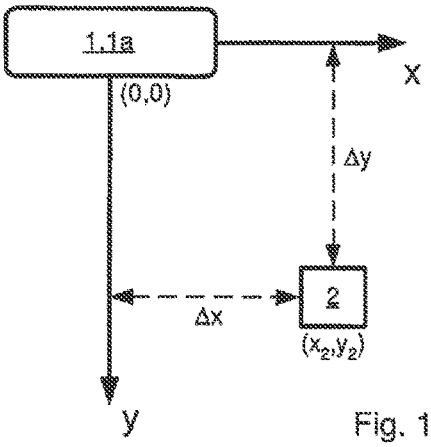
FIG. 1: Arrangement for determining the position of a loudspeaker in an installation room within a system of coordinates as a detail view of the system for position detection of loudspeakers and for reproduction of audio signals as stereoscopic sound FIG. 2. Arrangement of various loudspeakers of an object-based sound system in the installation room within a system of coordinates, and FIG. 3. Arrangement of the loudspeakers in the installation room for generating a virtual sound room.

FIG. 1 shows an arrangement for determining the position of a loudspeaker 2 with a base unit 1 with a signal processor 1*a* in an installation room within a system of coordinates as a detail view of the system 3 for position detection of loudspeakers 2 and for reproduction of audio signals as stereoscopic sound. The system of coordinates is characterized by the directions x and y. A direction z runs perpendicular to the directions x and y. The direction z and the thereby subtended x-z plane and y-z plane are used similarly to the represented x-y plane. All further arrangements and orientations explained in regard to the x-y plane should be applied analogously to the x-z plane and y-z plane.

The base unit 1 with the signal processor 1*a* is arranged at the origin of coordinates (0, 0) of the system of coordinates. The loudspeaker 2 is oriented in a position ($x_2$, $y_2$) in a plane of the system of coordinates, subtended by the direction x and y, at a distance from the base unit 1 and thus at a distance from the origin of coordinates (0, 0). The distances of the loudspeaker 2 from the origin of coordinates (0, 0) are indicated by Δx in the direction of the x axis and by Δy in the direction of the y axis. Analogous indications for the orientation in the direction of a z axis are omitted here.

The distances Δx and Δy from the origin of coordinates (0, 0) as reference point are automatically detected and processed as information within the signal processor 1*a*. The loudspeaker 2 is configured so that it can communicate with the signal processor 1*a* of the base unit 1, that is, send data or signals to the base unit 1 and receive data or signals from the base unit 1. The signal processor 1*a* is designed to query and receive the data for determining the position ($x_2$, $y_2$) of the loudspeaker 2.

The distances Δx, Δy of the loudspeaker 2 from, for example, the signal processor 1*a* arranged at the origin of coordinates (0,0) can be ascertained and transmitted in different ways, for example, by ultrasound, radar such as radio detection and ranging based on electromagnetic waves, wireless reproduction ("Wifi" or "wireless fidelity"), or WLAN ("wireless local area network"), Bluetooth, radio, as well as optical or mechanical principles, magnetic sensors, a global positioning system (GPS) as a navigation satellite system or the like. The distances Δx, Δy can also be determined from a combination of the different methods.

The communication and thus the transmittal of data or signals between the loudspeaker 2 and the signal processor 1*a* occur via a wired connection or a wireless connection.

Figure 2:
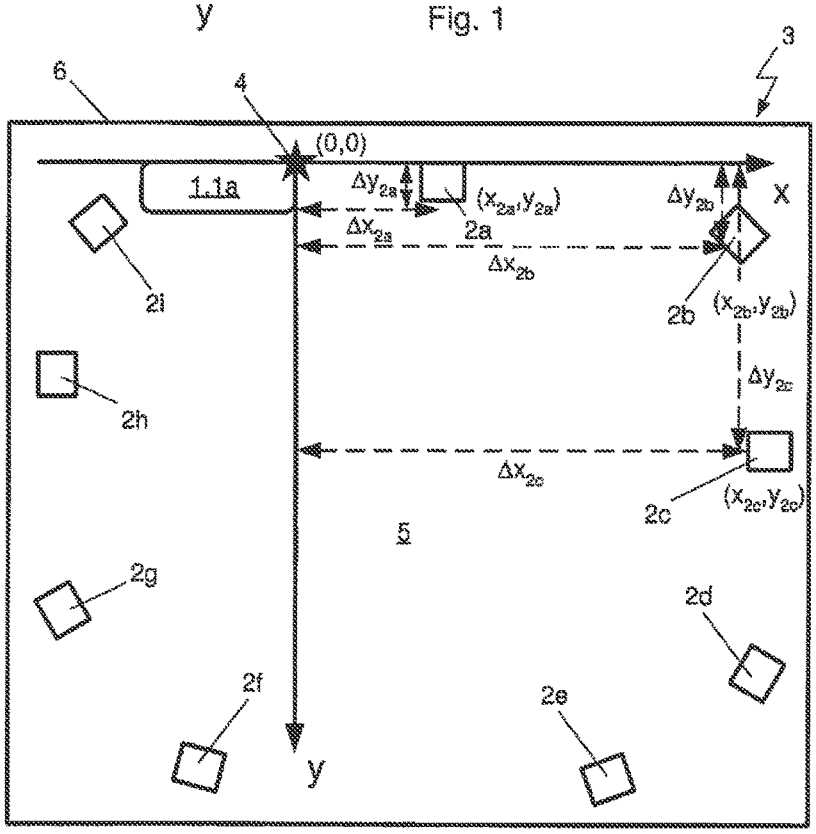

FIG. 2 shows an arrangement of various loudspeakers 2*a* to 2*i* of the system 3 of the base unit 1 with the signal processor 1*a* designed as an object-based sound system. The overall system 3 is arranged in an installation room 5 within the system of coordinates characterized with the directions x and y. The installation room 5 is enclosed by a room boundary 6.

The loudspeaker 2*a* is to be understood as a center loudspeaker, while the loudspeakers 2*b*, 2*i* are arranged as right and left front loudspeakers. The loudspeakers 2*c*, 2*d*, 2*e* arranged on one side of the y axis of the system of coordinates and the loudspeakers 2*f*, 2*g*, 2*h* arranged on the other side of the y axis of the system of coordinates are also known as side loudspeakers, while the loudspeakers 2*e*, 2*f* are also arranged as rear loudspeakers.

For a projection of the object-based sound system 3 into a passenger space of a motor vehicle, the y axis of the system of coordinates would be configured in the orientation of the driver, the loudspeaker 2*a* as the center loudspeaker would be positioned on a center axis of the motor vehicle in the viewing direction to the side and in front of the driver, the loudspeakers 2*b*, 2*c*, 2*d*, 2*g*, 2*h*, 2*i* would be arranged in the region of the side doors and the loudspeakers 2*e*, 2*f* would be arranged in the rear region of the passenger compartment. The x axis of the system of coordinates is oriented perpendicular to the driving direction of the motor vehicle.

The information on position ($x_{2a-2i}$, $y_{2a-2i}$), also known as location, and on the orientation of each individual loudspeaker 2*a*-2*i* in the installation room 5 is automatically detected and determined, as well as relayed to the signal processor 1*a* of the base unit 1 arranged at the reference point 4, for example, being configured to generate a virtual sound room for an object-based listening experience. The distances $\Delta x_{2a-2i}$ of each individual loudspeaker 2*a*-2*i* in the direction of the x axis and the distances $\Delta y_{2a-2i}$ in the direction of they axis from the origin of coordinates (0, 0) are determined. From the information on the location and the orientation of the individual loudspeakers 2*a*-2*i* in the installation room 5, the relative associations of the loudspeakers 2*a*-2*i* to and from each other are automatically determined.

Within the system 3, audio signals are generated and reproduced by the loudspeakers 2*a*-2*i*, processing in addition to the time-dependent amplitude of the audio signal also the data information pertaining to the audio signal, known as meta-data, such as the position of each loudspeaker 2*a*-2*i* for the generating of the audio signal by means of the coordinates $x_{2a-2i}$, $y_{2a-2i}$, the sound level, the frequency response, the echo and the phase reference to other audio signals. The signal processor 1*a* decomposes the audio signals based on the meta-data. In this, the position detection of each individual loudspeaker 2*a*-2*i* of the system 3 influences the parameters of the signal decomposition in the signal processor 1*a* and thus the calculation of the audio signals sent out by each loudspeaker 2*a*-2*i*.

In the object-based audio system, the pure audio information and the meta-data on the properties of the audio signal are separated from each other, so that a sound event for each track/channel is formed from two data streams. Since the properties can be established separately in all parameters for each sound event, each sound event is viewed and treated as an individual object. In the object-based audio system, the sound events can be scaled and adapted in a broad range.

With the help of a computation algorithm, depending on the application, the information for the generating of the audio signals is computed in the signal processor 1*a* and transferred to the corresponding loudspeakers 2*a*-2*i*. This makes possible an adapting of the sound to the respective parameters of the motor vehicle, especially the passenger compartment. With the help of the signal processor 1*a*, and depending on the positions ($x_{2a-2i}$, $y_{2a-2i}$), the arrangement and the orientation of the loudspeakers 2*a*-2*i*, a virtual sound room is created for an object-based listening experience, while the listening experience is not limited to the object-based sound. The properties of the audio signals are automatically adapted by the signal processor 1*a*. In the virtual sound room, the audio signals are reproduced in a vivid manner. The sound system 3 enables a sound reproduction which is independent of the loudspeakers 2*a*-2*i*, that is, the positions ($x_{2a-2i}$, $y_{2a-2i}$), the arrangements, and the orientation of the loudspeakers 2*a*-2*i*, and thus one which is perfectly flexible.

The audio information of a corresponding audio source is decomposed within the signal processor 1*a* to create a virtual stereoscopic sound, based on the overall arrangement. After this, the decomposed audio information within the system 3 is placed in relation to the positions ($x_{2a-2i}$, $y_{2a-2i}$) of the loudspeakers 2*a*-2*i*. The audio signals are then reproduced stereoscopically by means of the object-based sound system 3.

The determination of the absolute positions ($x_{2a-2i}$, $y_{2a-2i}$), the arrangement, and the orientation of the individual loudspeakers 2*a*-2*i* in the installation room 5 or within the system of coordinates, the determination of the relative positions and distances of the individual loudspeakers 2*a*-2*i* among each other, the transmittal of the data on the absolute or relative positions of the loudspeakers 2*a*-2*i* to the signal processor 1*a* and the transmittal of the data on the audio signals from the signal processor 1*a* to the loudspeakers 2*a*-2*i* occur with the aid of a communication protocol. All data and signals are transmitted in this way to the signal processor 1*a* and processed by the signal processor 1*a* and information on audio signals is generated. According to an alternative embodiment, not shown, each loudspeaker is associated with a signal processor, and the signal processors are linked together for exchanging data.

Figure 3:
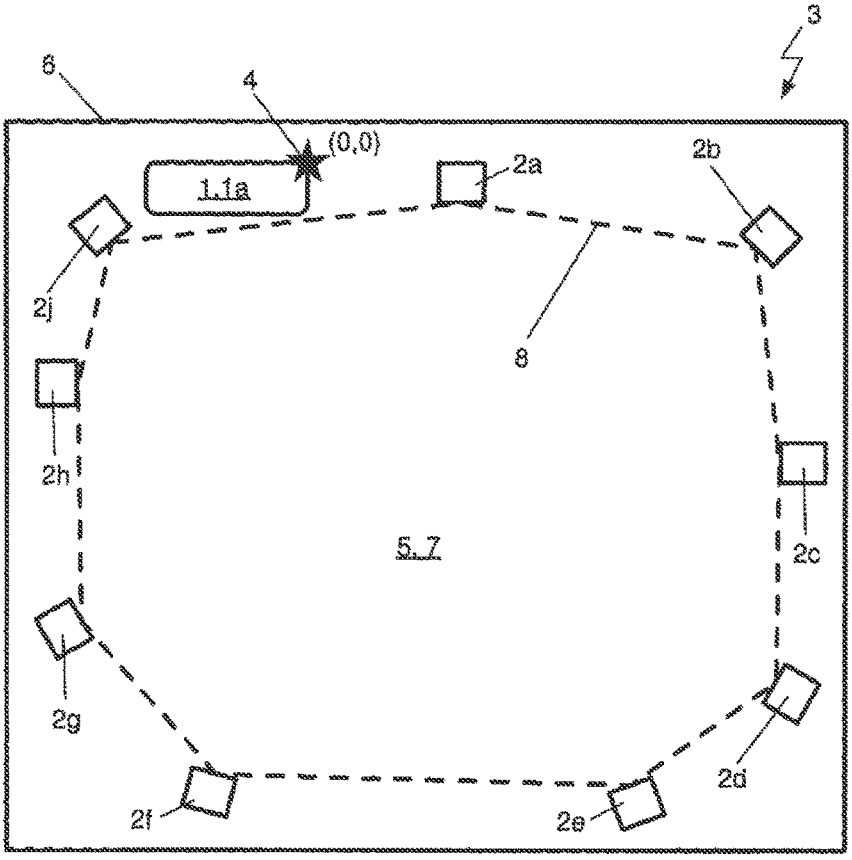

FIG. 3 shows an arrangement of the loudspeakers 2*a*-2*i* and the base unit 1 with the signal processor 1*a* of the sound system 3 for generating a virtual sound room 7 within the installation room 5.

The sound room 7 is enclosed by a boundary 8. The boundary 8 extends from the front side of the loudspeakers 2*a*-2*i* to the directly adjacent loudspeaker 2*a*-2*i*, so that the boundary 8 forms a closed line.

An optimal function of the sound system 3 is achieved in a four-cornered installation room 5, in which each loudspeaker 2*a*-2*i* is visible from the base unit 1 or the signal processor 1*a*.

What is claimed is:

1. A system for producing a stereoscopic sound, comprising:

a signal processor situated in a base station at a centralized location in an installation room;

at least one loudspeaker, the at least one loudspeaker being arranged at a distance from the centralized location, wherein the at least one loudspeaker is configured to receive an audio signal from the signal processor and to send data for determining a position and an orientation of the at least one loudspeaker to the signal processor, wherein the signal processor is configured to:

receive the data for determining the position and the orientation of the at least one loudspeaker from the at least one loudspeaker, determine the position and orientation of the at least one loudspeaker based on the data received from the at least one loudspeaker, generate the audio signal for the at least one loudspeaker based on the determined position and the determined orientation, and communicate the audio signal to the at least one loudspeaker, and wherein the data sent from the at least one loudspeaker comprises meta-data pertaining to the audio signal and wherein a sound event for each track or channel is created based on two data streams including pure audio data and the meta-data, wherein distances of each individual loudspeaker in the direction of the x axis and the direction of the y axis are determined with respect to the location of the base unit using the data for determining the position sent as metadata from the at least one loudspeaker, and wherein the audio signal played by the at least one loudspeaker is based on the coordinates, the sound level, the frequency response, the echo and the phase reference of other audio signals played by other loudspeakers.

2. The system according to claim 1, wherein the signal processor is further configured to determine the position and orientation automatically.

3. The system according to claim 1, wherein the signal processor as well as the at least one loudspeaker are arranged within a system of coordinates with an origin of coordinate being defined as the centralized location.

4. The system according to claim 1, wherein the signal processor and the at least one loudspeaker are connected to each other wirelessly.

5. The system according to claim 1, further comprising:

at least two or more loudspeakers, the at least two or more loudspeakers being configured to receive the audio signal and to send data for determining a position and an orientation of the at least two or more loudspeakers to the signal processor, wherein the signal processor is further configured to:

determine the position and the orientation for each of the at least two or more loudspeakers based on the data received from the at least two or more loudspeakers, generate the audio signal for each of the at least two or more loudspeakers based on the determined position and the determined orientation, and communicate the audio signal to the at least two or more loudspeakers.

6. The system according to claim 1, wherein the audio signal is object-based.

7. A system for producing a stereoscopic sound, comprising:

a signal processor situated in a base unit at a centralized location in an installation room;

at least one loudspeaker, the at least one loudspeaker being arranged at a distance from the centralized location, wherein the at least one loudspeaker is configured to receive an audio signal from the signal processor and to send data for determining a position and an orientation of the at least one loudspeaker to the signal processor using at least one of ultrasound, radar, wireless reproduction, wireless local area network, Bluetooth, radio, magnetic sensors, and a global positioning system (GPS), wherein the signal processor is configured to:

receive the data for determining the position and the orientation of the at least one loudspeaker from the at least one loudspeaker, determine the position and the orientation of the at least one loudspeaker based on the data received from the at least one loudspeaker, generate the audio signal for the at least one loudspeaker based on the determined position and the determined orientation, and communicate the audio signal to the at least one loudspeaker, and wherein the data sent from the at least one loudspeaker comprises meta-data pertaining to the audio signal and wherein a sound event for each track or channel is created based on two data streams including pure audio data and the meta-data, wherein distances of each individual loudspeaker in the direction of the x axis and the direction of the y axis are determined with respect to the location of the base unit using the data for determining the position sent as metadata from the at least one loudspeaker, and wherein the audio signal played by the at least one loudspeaker is based on the coordinates, the sound level, the frequency response, the echo and the phase reference of other audio signals played by other loudspeakers.

8. The system according to claim 7, wherein the signal processor is further configured to determine the position and orientation automatically.

9. The system according to claim 7, wherein the signal processor as well as the at least one loudspeaker are arranged within a system of coordinates with an origin of coordinate being defined as the centralized location.

10. The system according to claim 7, wherein the signal processor and the at least one loudspeaker are connected to each other wirelessly.

11. The system according to claim 7, further comprising at least two or more loudspeakers, the at least two or more loudspeakers being configured to receive unique audio signals and to send data for determining a position and an orientation of the at least one loudspeaker to the signal processor using at least one of ultrasound, radar, wireless reproduction, wireless local area network, Bluetooth, radio, magnetic sensors, and a global positioning system (GPS), wherein the signal processor is further configured to:

receive the data for determining the position and the orientation of the at least one loudspeaker from the at least one loudspeaker, determine a position and orientation for each of the at least two or more loudspeakers based on the data received from the at least one loudspeaker, generate a unique audio signal for each of the at least two or more loudspeakers based on the determined position and the determined orientation, and communicate the audio signal to the at least two or more loudspeakers.

12. The system according to claim 11, wherein the signal processor employs an automatic technique to perform the determination of position and orientation.

13. The system according to claim 7, wherein the data includes the determined position and the determined orientation.

14. The system according to claim 13, wherein each of the at least two or more loudspeakers includes a unique signal processor, and the unique signal processor is configured to modify the audio signal based on the received determined position and the determined orientation.

15. The system according to claim 7, wherein the signal processor is implemented in a head unit of a vehicle.

16. The system according to claim 7, wherein the signal processor employs an automatic technique to perform the determination of position and orientation.

17. The system according to claim 7, wherein the audio signal is object-based.

18. A method for producing a stereoscopic sound using a signal processor situated in a base unit at a centralized location in an installation room and at least one loudspeaker, the at least one loudspeaker being arranged at a distance from the centralized location, wherein the at least one loudspeaker is configured to receive an audio signal from the signal processor and to send data for determining a position and an orientation of the at least one loudspeaker to the signal processor, the method comprising:

receiving, by the signal processor, the data for determining the position and the orientation of the at least one loudspeaker from the at least one loudspeaker, determining, by the signal processor, the position and orientation of the at least one loudspeaker based on the data received from the at least one loudspeaker, generating, by the signal processor, the audio signal for the at least one loudspeaker based on the determined position and the determined orientation, and communicating, by the signal processor, the audio signal to the at least one loudspeaker, wherein the data sent from the at least one loudspeaker comprises meta-data pertaining to the audio signal and wherein a sound event for each track or channel is created based on two data streams including pure audio data and the meta-data, wherein distances of each individual loudspeaker in the direction of the x axis and the direction of the y axis are determined with respect to the location of the base unit using the data for determining the position sent as metadata from the at least one loudspeaker, and wherein the audio signal played by the at least one loudspeaker is based on the coordinates, the sound level, the frequency response, the echo and the phase reference of other audio signals played by other loudspeakers.

19. The method according to claim 18, wherein the determining the position and orientation is performed automatically by the signal processor.

20. The method according to claim 18, wherein the signal processor as well as the at least one loudspeaker are arranged within a system of coordinates with an origin of coordinate being defined as the centralized location and the data indicates position with respect to the system of coordinates.

* * * * *